US005791069A

United States Patent [19]

Oradesky

[11] Patent Number: 5,791,069

[45] **Date of Patent: *Aug. 11, 1998**

[54] POINTED TOE SHOE CONSTRUCTION

[76] Inventor: Walter Odysseus Oradesky, 59-20 162nd St., Flushing, N.Y. 11365

[21] Appl. No.: 820,226

[ * ] Notice: This patent issued on a continued prosecution application filed under 37 CFR 1.53(d), and is subject to the twenty year patent term provisions of 35 U.S.C. 154(a)(2).

[22] Filed: Mar. 18, 1997

[51] Int. Cl.[6] ..... A43B 7/26

[52] U.S. Cl. ..... 36/94; 36/71; 36/77 R

[58] Field of Search ..... 36/94, 95, 96, 36/97, 77 R, 71, 72 R

[56] References Cited

U.S. PATENT DOCUMENTS

| | | | |
|---|---|---|---|
| 741,567 | 10/1903 | Turner | 36/77 R |
| 1,175,718 | 3/1916 | Crowe | 36/95 X |
| 1,819,766 | 8/1931 | Capezio | 36/96 X |
| 2,275,453 | 4/1942 | Finnan, Jr. . | |
| 2,751,691 | 6/1956 | Clark, Jr. . | |
| 2,810,214 | 10/1957 | Wolfe | 36/96 X |
| 2,878,597 | 3/1959 | Justin, Jr. . | |
| 3,012,340 | 12/1961 | Reinhart . | |
| 5,311,676 | 5/1994 | Hughes et al. . | |

FOREIGN PATENT DOCUMENTS

| | | | |
|---|---|---|---|
| 2259206 | 6/1974 | Germany | 36/72 R |
| 405095804 | 4/1993 | Japan | 36/96 |
| 204833 | 5/1939 | Switzerland | 36/77 X |
| 26344 | 11/1908 | United Kingdom | 36/77 R |
| 439336 | 12/1935 | United Kingdom | 36/77 R |
| 2188531 | 10/1987 | United Kingdom | 36/72 R |

*Primary Examiner*—Ted Kavanaugh
*Attorney, Agent, or Firm*—Collard & Roe, P.C.

[57] ABSTRACT

A shoe comprising a sole having a front end that tapers and comes to a point, a heel attached to the back end of the sole, an upper portion attached around the perimeter of the sole to form a shoe having a pointed toe section, and a toe line insert placed at the front of the inner surface of the sole in between the sole and the upper. The toe line insert forms a barrier between the wearer's feet and the pointed toe section. The toe line insert is curved and substantially conforms to the shape of a wearer's toe line. The toe line insert prevents the wearer's toes from entering the pointed toe section. A filler may be placed between the toe line insert and the front end of the shoe to maintain the structure of the front end.

4 Claims, 1 Drawing Sheet

POINTED TOE SHOE CONSTRUCTION

BACKGROUND OF THE INVENTION

1. Field of the Invention

This invention relates to a novel shoe construction. In particular, the invention relates to a shoe that externally appears to have a pointed toe, but internally conforms to the shape of the wearer's toe line.

2. The Prior Art

Shoes with pointed toes are at times considered very stylish, especially with ladies' shoes. While the pointed toe look is seen as very attractive, it is not considered to be very comfortable, especially in shoes that have a high heel. The wearer's toes often are forced into the narrow pointed end and, with prolonged use, can develop corns, callouses, and, in extreme cases, permanent deformities.

There are several prior art patents that attempt to overcome problems with manufacturing pointed toes for shoes, or which attempt to provide the ability to create several different looks from one pair of shoes. However, none of the prior art references show a way to manufacture a shoe that appears to have a pointed toe section but which conforms to the shape of the wearer's toes on the inside.

U.S. Pat. No. 2,878,597 to Justin shows a pre-molded box toe for use in manufacturing cowboy boots. The toe is made from molded plastic and then attached to the boot during manufacture. This process eliminates that costly and time consuming process of forming the pointed toe by hand. In use, the wearer's toes extend into the pointed toe section, thus creating the potential for discomfort.

U.S. Pat. No. 2,751,691 to Clark shows a shoe construction having a removable toe cap that can be interchanged to match the apparel of the wearer. The toe cap is shown to fit snugly over the shoes. This invention does not show how to make a shoe having a pointed toe look. Furthermore, the toe cap is plainly visible as a separate attachment to the shoe. In addition, should the cap have a A pointed toe shape, the wearer's toes would extend into the pointed toe section, thus creating the potential for discomfort.

Neither of these references solves the problem of creating a shoe having the look of a pointed toe or section but which conforms to the shape of a wearer's toes.

SUMMARY OF THE INVENTION

It is therefore an object of the present invention to overcome the drawbacks of the prior art and to create a shoe construction that conforms to the shape of a wearer's toe line on the inside, but which appears to have a pointed toe or other shape on the outside.

It is another object of the present invention to provide a shoe construction in which the pointed toe or other shape appears to be integrally formed with the rest of the shoe.

These and other objects and features of the present invention are accomplished by a shoe construction having a sole, an upper attached to the sole, a heel attached to the sole and a toe line insert. The sole and upper have a toe section that tapers and comes to a point or other shape at its end. The toe line insert is placed between the sole and the upper in the toe section of the shoe. The toe line insert conforms to the shape of the wearer's toe line. The toe line insert is permanently affixed to the shoe, by gluing or otherwise attaching it to the upper, the sole or both. This way, the toe line insert is an integral part of the shoe and cannot move around within the shoe while it is being worn.

The toe line insert is preferably formed from a substance that will maintain its shape over prolonged use and exposure to perspiration, dirt and wear. The toe line insert can be constructed of shoe leather material or other suitable material.

The area between the toe line insert and the inside of the pointed toe section can be filled with a variety of materials such as a hollow plastic form, or by a solid substance such as rubber, or a filled leather or cloth pillow-type structure so as to provide support for the toe line insert, as well as support for the shoe upper, preventing it from collapsing.

In addition, the toe line insert and material used to fill the area between the toe line insert and the inside of the pointed toe section could be combined as one unit and then permanently affixed to the shoe, by gluing or otherwise attaching it to the upper, the sole or both.

The shoe is made so that it is slightly longer, but not larger in any other respects, than a traditional pointed toe shoe of a corresponding shoe size. This is to accommodate the toe line insert without altering the form-fitting shape of the rest of the shoe to the wearer's foot.

The shoe appears identical to many other pointed toe shoes that are on the market. The entire upper of the shoe is formed from the same type of covering used for conventional shoes, such as leather, silk, canvas or other suitable material. The use of the toe line insert cannot be detected when the shoe according to the invention is worn. However, the toe line insert protects the wearer's toes from deformities, corns and calluses and ensures a comfortable fit even during long periods of standing.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
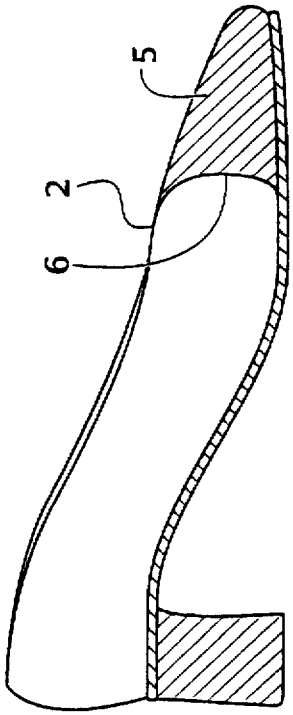
FIG. 1 is a longitudinal cross-sectional view of one embodiment of the shoe according to the invention.

Turning now in detail to the drawings, and in particular, FIG. 1, there is shown a longitudinal cross section of the shoe according to the invention. Shoe 1 is comprised of an upper 2, a sole 3 and a heel 4. Within shoe 1, between upper 2 and sole 3 at the toe section of shoe 1, there is placed a toe line insert 6. Beyond insert 6, in the toe region of the shoe, filler 5 is placed to maintain the shape of the shoe. The front portion of filler 5 conforms to the shape of the shoe in front. The rear portion of filler 5 conforms to the shape of the toe line insert. Because pointed toe shoes are not shaped to conform to a wearer's toe line, toe line insert 6 accommodates the wearer's actual toe line, thus increasing comfort while enabling the wearing of stylish shoes.

Shoe 1 is constructed to be slightly longer in the toe area than a standard shoe of corresponding shoe size. This is to accommodate toe line insert 6 and filler 5 into the toe portion of shoe 1. The rest of shoe 1 is constructed similar to other shoes of the same style.

Figure 4:
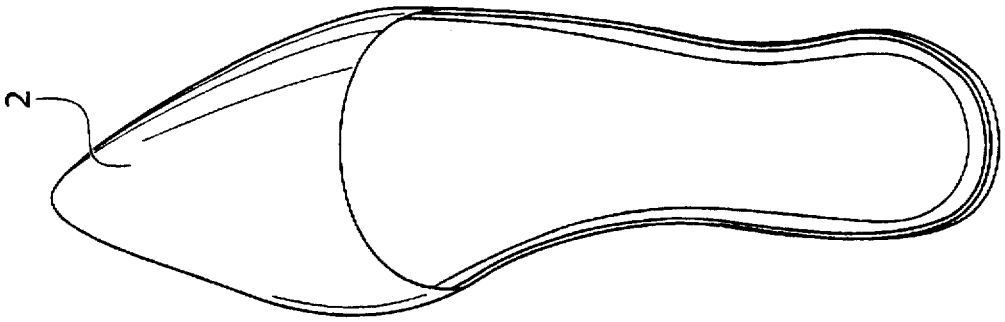
FIG. 4 is a top view of the shoe according to the invention.
Figure 2:
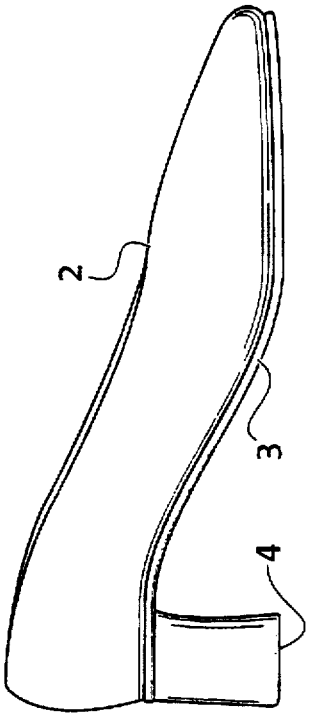
FIG. 2 is a side view of the shoe according to the invention.

As can be seen in FIGS. 2 and 4, the outside of shoe 1 appears to be the same as any standard shoe. The extra accommodation for toe line insert 6 is not apparent when shoe 1 is viewed from the outside.

Figure 3:
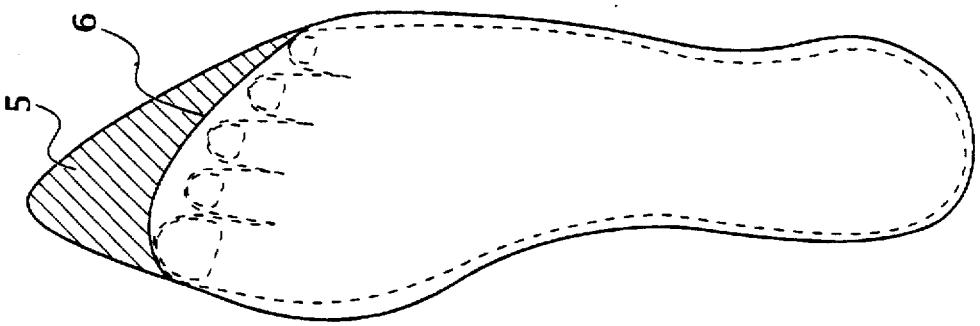
FIG. 3 is a top view of the shoe according to FIG. 4 with the upper removed.

FIG. 3 shows a top view of shoe 1, with upper 2 removed. As can be seen, toe line insert 6 follows the natural curve of a person's toe line, to comfortably encase the wearer's feet within shoe 1. Unlike with normal pointed toe shoes, a wearer's toes cannot slide into the pointed toe area, which can cause considerable discomfort over extended periods of time, especially with high heeled shoes.

Toe line insert 6 can be made from any suitable material, such as shoe leather. Other materials could also be envisioned. Toe line insert 6 is preferably made from a material that is slightly pliable, so that it yields slightly if a wearer's toes are slid up against insert 6. The important aspect of toe line insert 6 is that it conforms to match a person's toe line.

Filler 6 can be made of any suitable material, such as a hollow plastic form or a filled pillow structure made of cloth, leather or other material.

Accordingly, while only a few embodiments of the present invention have been shown and described, it is obvious that many changes and modifications may be made there unto without departing from the spirit and scope of the invention.

What is claimed is:

1. A shoe having a front and a back and comprising:

a sole having an outer surface, an inner surface, a front end and a back end, said front end being tapered and coming to a point at an acute angle;

a heel attached to the outer surface of the sole at the back end;

an upper portion attached around the perimeter of the sole to form a shoe having an elongated pointed toe section having at tip coming to a point at an acute angle, wherein said pointed toe section is disposed entirely in front of a wearer's toe line, and a filler disposed in the elongated pointed toe section at the front of the inner surface of the sole in between the sole and the upper portion and forming a barrier between the wearer's feet and said tip of said upper portion, said filler having a rear portion being slightly curved and substantially conforming to the shape of the wearer's toe line and a front having a shape that corresponds to said tip, such that said filler prevents the wearer's toes from entering the pointed toe section.

2. The shoe of claim 1, wherein the filler is comprised of shoe leather.

3. The shoe of claim 1, wherein the filler is comprised of a hollow plastic form.

4. The shoe of claim 1, wherein the filler is comprised of a filled pillow.

* * * * *